US007882950B2

(12) United States Patent
Nazari

(10) Patent No.: US 7,882,950 B2
(45) Date of Patent: Feb. 8, 2011

(54) WINE BOTTLE PACKAGING AND CARRIER FORMED OF CARDBOARD SHEET

(76) Inventor: Joseph Nazari, 2000 Starvale Rd., Glendale, CA (US) 91207

( * ) Notice: Subject to any disclaimer, the term of this patent is extended or adjusted under 35 U.S.C. 154(b) by 0 days.

(21) Appl. No.: 12/430,726

(22) Filed: Apr. 27, 2009

(65) Prior Publication Data

US 2010/0270199 A1 Oct. 28, 2010

(51) Int. Cl.
*B65D 73/00* (2006.01)

(52) U.S. Cl. ..... 206/488; 206/780; 206/485; 206/486; 229/117.14

(58) Field of Classification Search ..... 206/488, 206/486, 485, 780, 776, 189, 194, 779, 162, 206/463, 476; 229/117.14
See application file for complete search history.

(56) References Cited

U.S. PATENT DOCUMENTS 3,203,542 A * 8/1965 Lightner et al. ..... 206/463
3,685,649 A * 8/1972 Diehl ..... 206/45.24
4,039,079 A * 8/1977 Laughton ..... 206/461
4,496,052 A * 1/1985 Nertman ..... 206/470
4,549,654 A * 10/1985 Tiesman ..... 206/486
4,570,787 A * 2/1986 Forbes, Jr. ..... 206/780

* cited by examiner

*Primary Examiner*—J. Gregory Pickett
*Assistant Examiner*—Blaine G Neway
(74) *Attorney, Agent, or Firm*—Chen Yoshimura LLP

(57) ABSTRACT

A package for individual wine bottles includes a box shaped lower portion having a top side defining a first cutout for receiving a bottom portion of a bottle and a flat handle portion joined to and extending vertically from the top side of the box shaped lower portion. The handle porting defines a second cutout for accommodating the bottle. The box shaped lower portion and the flat handle portion are formed by folding a single corrugated cardboard sheet that has been cut into a predefined shape. Packaging wine bottles using this package is done in two stages. First, collapsible half-formed packages are manufactured by cutting corrugated cardboard sheets into the predefined shape and folding the sheets. Second, the half-formed packages are collapsed and transported to another facility such as a winery, where bottles of wine are packaged using the half-formed packages.

7 Claims, 7 Drawing Sheets

WINE BOTTLE PACKAGING AND CARRIER FORMED OF CARDBOARD SHEET

BACKGROUND OF THE INVENTION

1. Field of the Invention

This invention relates to a packaging and carrier for wine bottles or bottles of other spirits formed of a cardboard sheet.

2. Description of the Related Art

An existing packaging method for packaging individual bottles of wine is to use a blister pack, which includes a plastic enclosure (the blister) for housing the wine bottles, where the blister has a flat wing around its peripheral which is held between two flat boards (typically cardboard sheets). The packaged bottles (typically one or more bottles) can be displayed in club stores (e.g. on tray displays), or as gift baskets which can be easily carried and presented. In this kind of packaging, large size plastic enclosure must be used to house the wine bottles. Plastic packaging materials are not environmentally friendly because they are typically made from petroleum polymers and are not recyclable or biodegradable. Also, the blister pack needs to be packaged at a packaging facility with sealing machines and other machines.

SUMMARY OF THE INVENTION

Accordingly, the present invention is directed to a package and packaging method for packaging individual bottle or bottles of wine that substantially obviates one or more of the problems due to limitations and disadvantages of the related art.

An object of the present invention is to provide a package and packaging method for packaging individual bottle(s) of wine that significantly reduces the use of plastic materials.

Additional features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, the present invention provides a package for bottles, which includes: a box shaped lower portion having a top side defining a first cutout for receiving a bottom portion of a bottle; and a flat handle portion joined to and extending vertically from the top side of the box shaped lower portion, the handle porting defining a second cutout for accommodating the bottle when the bottom portion of the bottle is disposed inside the box shaped lower portion, wherein the box shaped lower portion and the handle portion are formed from one or more corrugated cardboard sheets.

In another aspect, the present invention provides a corrugated cardboard sheet cut into a pre-defined shape for folding into the above package for bottles.

It is to be understood that both the foregoing general description and the following detailed description are exemplary and explanatory and are intended to provide further explanation of the invention as claimed.

DETAILED DESCRIPTION OF THE PREFERRED EMBODIMENTS

Figure 1:
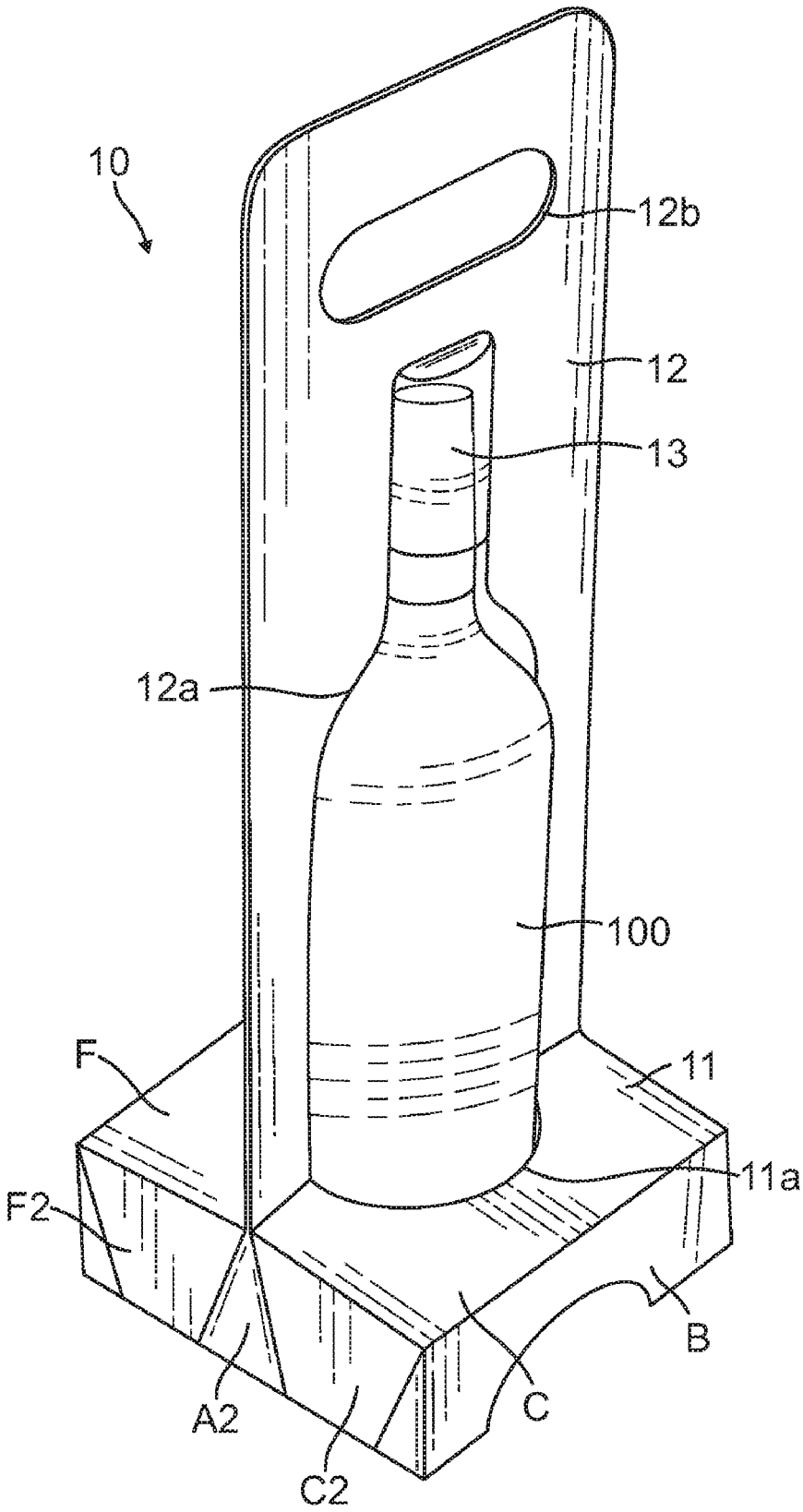
FIG. 1 is a perspective view of a wine carrier with a wine bottle packaged therein according to an embodiment of the present invention.

FIG. 1 is a perspective view of a wine carrier 10 with a wine bottle 100 packaged therein. The wine carrier 10 has a rectangular box shaped lower portion 11 and a flat handle portion 12 joined to and extending vertically upwards from the top of the box portion 11. The box portion 11 is formed of single-sheet cardboard walls, except for the bottom panel and the folding tabs as will be described later; the handle portion 12 is formed of two overlapping cardboard sheets adhered to each other. The box portion 11 has a circular cutout 11*a* at its top so that a bottom portion of the wine bottle 100 pass through the cutout 11*a* and sits inside of the box portion 11. The handle portion 12 has a cutout 12*a* through which the body of the wine bottle 100 passes. Preferably, the handle portion 12 has another cutout 12*b*, located above the cutout 12*a*, which can be used to hold the carrier 10 by hand.

Figure 7:
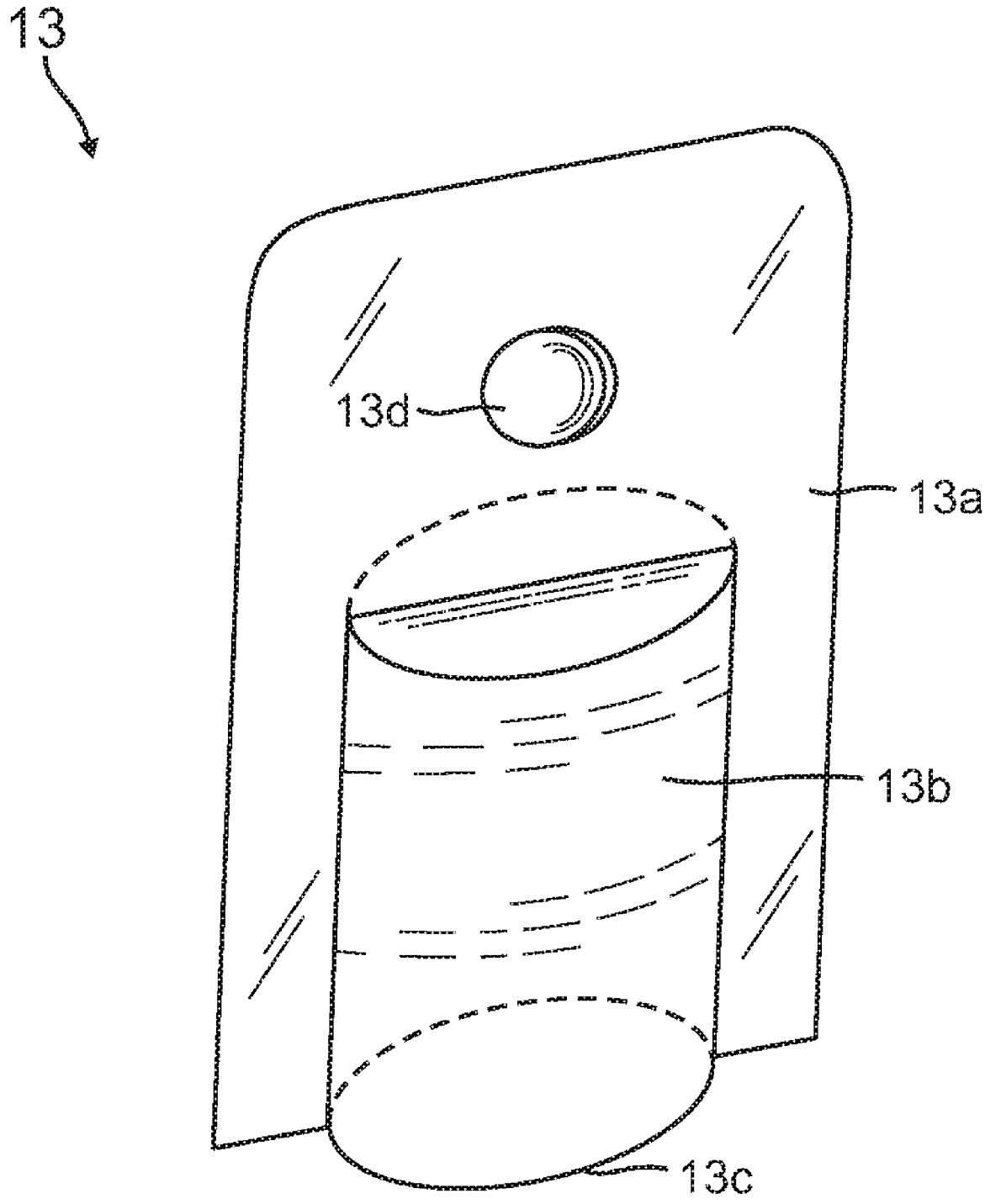
FIG. 7 is a perspective view of the retaining cap of the wine carrier of FIG. 1.

A cylindrical shaped retaining cap 13, preferably made of thin clear plastic, is disposed near the top of the cutout 12*a*. The retainer cap has a structure similar to a blister container in a conventional blister package. As shown in FIG. 7, the retaining cap 13 has a hollow cylindrical body 13*b* and a flange 13*a* extending outwardly from the cylindrical body 13*b* and disposed in a plane that passes through an axis of the cylindrical body 13*b*. The retaining cap 13 is located near the top of the cutout 12*b*; the flange 13*a* is trapped between the two cardboard sheets that form the handle portion 12, and the cylindrical body 13*b* protrudes from both sides of the plane of the flat handle portion 12. The cylindrical body 13*b* is open at its bottom (see 13*c* in FIG. 7), and the neck of the wine bottle 100 is inserted into the cylindrical body 13*b*.

The retaining cap 13 may be made as one piece, e.g. using injection molding. Alternatively, it may be made as two pieces, e.g., using vacuum forming, each piece being the shape of a half cylinder with a flange. The two pieces are put against each other with the flanges overlapping each other to form the cylindrical shaped retaining cap 13.

Figure 2:
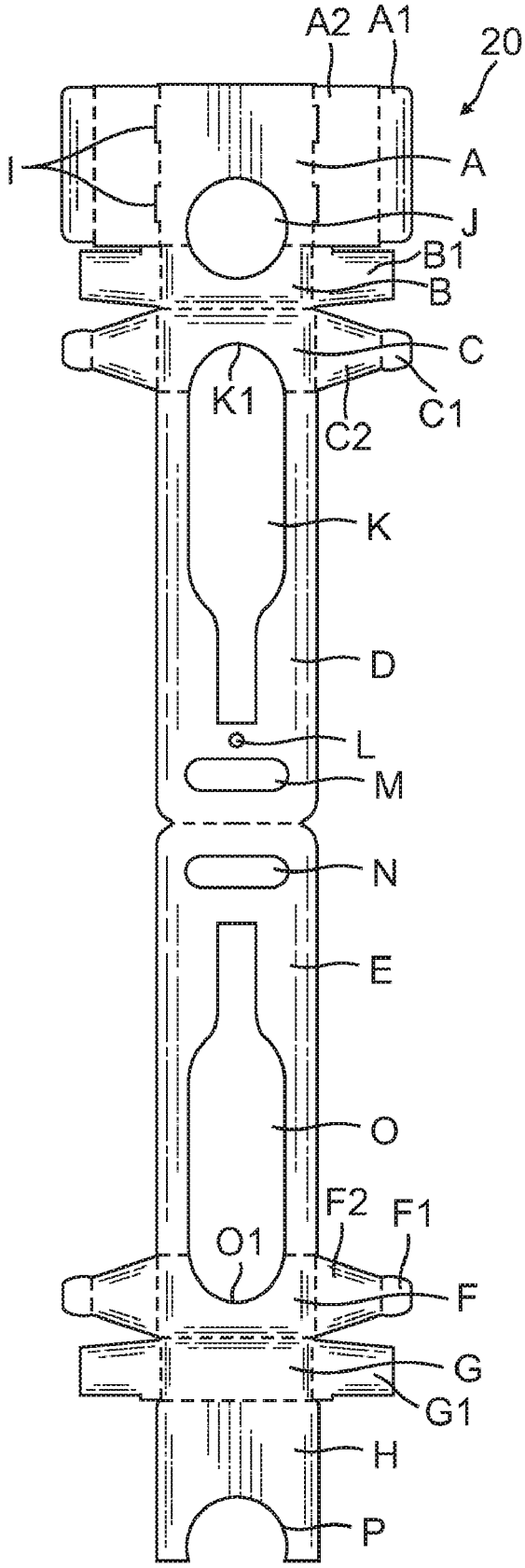
FIG. 2 illustrates a cardboard sheet cut into shape for forming the wine carrier of FIG. 1.

The retaining cap 13 may be securely trapped between the two cardboard sheets of the handle 12 in various ways. The flange 13*a* may be glued to the cardboard sheets by an adhesive. Alternatively, a small protrusion 13*d* is provided on the flange 13*a*, for example above the top of the cylindrical body 13*b*, and a corresponding small cutout is formed in one of the cardboard sheets of the handle 12. This cutout is not shown in FIG. 1, but is shown in FIG. 2 as cutout L as described later. The protrusion 13*d* is pressed to protrude from this cutout to prevent the retaining cap 13 from sliding while sandwiched between the two cardboard sheets.

The width of the cutout 12*a* is sufficiently large to accommodate the diameter of typical wine bottles. The height and the shape of the shoulder of the cutout 12*a* are such that the cutout 12*a*, taking into consideration the height of the box portion 11, can accommodate typical wine bottles. An empty space may be left at the top of the retaining cap 13 when a relatively short bottle is packaged. The cutout 12*a* may also be cut into a custom shape for a particular wine bottle.

The box portion 11 and the handle portion 12 of the carrier 10 are formed from a single sheet of cardboard by folding. The type of cardboard sheet used is of suitable thickness. For example, a 200 to 275 test cardboard sheet may be used for heavier bottles, ad E flute or F flute corrugated sheet may be used for lighter bottles. Paper board sheets without corrugation may also be used for lighter weight items. FIG. 2 illustrates a single corrugated cardboard sheet 20 cut into a shape that includes sections A through H as shown. Fold lines indicated by dashed lines are pre-formed at locations between adjacent sections of A through H. Sections A, B, C, F, G and H will form the box portion 11 and sections D and E will form the handle portion 12 of the carrier 10. Cutouts J through O are formed into various sections as shown, where cutout J is located in sections A and B, cutout K is located in sections C and D, cutouts L and M are located in section C, cutout N is located in section D, and cutout O is located in sections E and F. Cutouts M and N correspond to the cutout 12*b* of the handle 12. Cutout L is for passing the small protrusion 13*d* of the retainer cap 13. The parts of cutouts K and O located respectively within sections D and E correspond to the cutout 12*a* of the handle 12. The semi-circular parts K1 and O1 of cutouts K and O located respectively within sections C and F jointly correspond to the top cutout 11*a* of the box portion 11.

Within sections A, B, C, F and G, pre-formed fold lines are provided to divide these sections into various subsections which will function as side walls or folding tabs to form the box 11. Some of the folding tabs (A1, A2, B1, C1, C2, F1, F2 and G1) are labeled in FIG. 2 for future reference. In addition, four slit cuts I are made in section A as shown, which will be used for inserting folding tabs into when forming the box 11.

Figure 3:
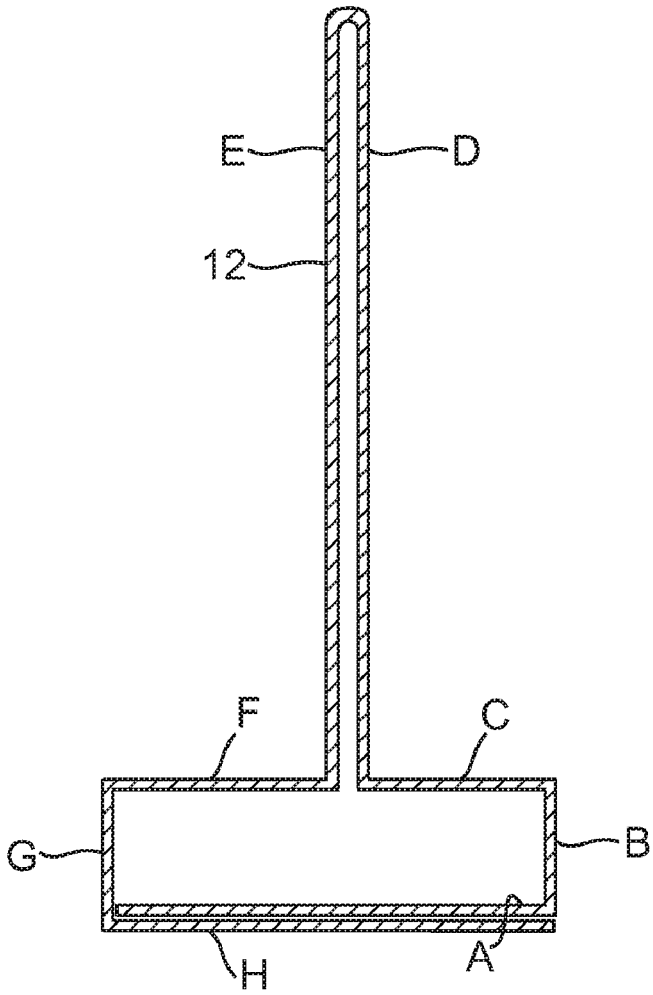
FIG. 3 is a side view illustrating the positions of the various sections of the cardboard sheet in a formed or half-formed wine carrier of FIG. 1.

FIG. 3 is a side view illustrating the positions of the various sections A through H in the formed wine carrier 10 (for clarity, the folding tabs and some side walls are not shown). As shown in FIG. 3, sections H and A are overlapped with each other to form the bottom panel of the box 11; sections G and B form two side walls of the box 11; sections F and C jointly form the top side of the box 11; and sections E and D form the handle 12.

The cardboard sheet 20, including the pre-formed folding lines, cutouts and slits, is typically made from a larger cardboard sheet by a cardboard sheet manufacturer. The process of packaging wine bottles using the cardboard sheets 20 is done in two stages. In the first stage, the cut sheets 20 are formed into half-formed carriers. This stage, which does not involve handling any wine bottles, is typically performed at a packaging facility that employs sealing machines. The half-formed carriers are then transported to a location where wine bottle are stored to perform the second stage of packaging. In the second stage, wine bottles are packaged into the half-formed carriers to form the final packaged product. This stage involves putting the wine bottles into the half-formed carriers and performing additional folding to form the carriers into the desired shape; it can be done by hand without requiring any packaging machines.

Such a two-stage packaging process has many advantages. Conventionally, packaging wine bottles in carriers requires the wine maker to ship the wine bottles to the packaging facility which employs sealing machines and other machines, where the wine bottles are packaged. Using the wine carrier and packaging process according to embodiments of the present invention, the wine maker does not need to ship the wine to the packaging facility, thereby eliminating associated shipping cost. Further, the packaging facility does not need to handle any wine, thereby eliminating any license requirement that may be imposed by governments for handling alcohol.

The two stage packaging process is described in more detail below.

Figure 4:
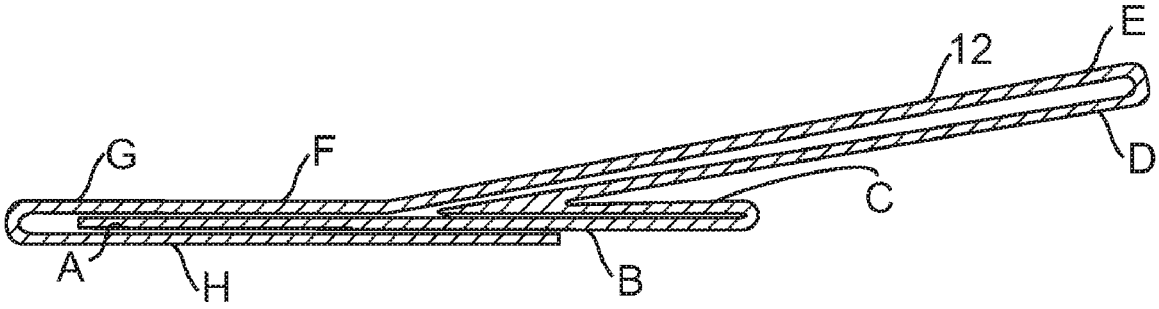
FIG. 4 is a side view illustrating a half-formed wine carrier of FIG. 1 in a collapsed state without a wine bottle.

In the first stage, the cardboard sheet 20 shown in FIG. 2 is folded along the pre-formed folding line between sections D and E so that sections D and E overlap with each other. The flange 13*a* of the retaining cap 13 is inserted between sections D and E at the top of the cutouts O and K, and sections D and E are sealed together with an appropriate adhesive, securing the retaining cap 13 in place. Folding is performed along additional folding lines between adjacent sections A through H to bring the sections A and H to overlap with each other as shown in FIG. 3 or FIG. 4. Sections A and H are sealed together with an appropriate adhesive. The sealing of the sections A and H and sections E and D are typically done using a sealing machine of the packaging facility. At this time, the subsections within sections A, B, C, F, G and H (i.e. the folding tabs) are not folded, and the wine carrier 10 is in a half-formed state.

Figure 8:
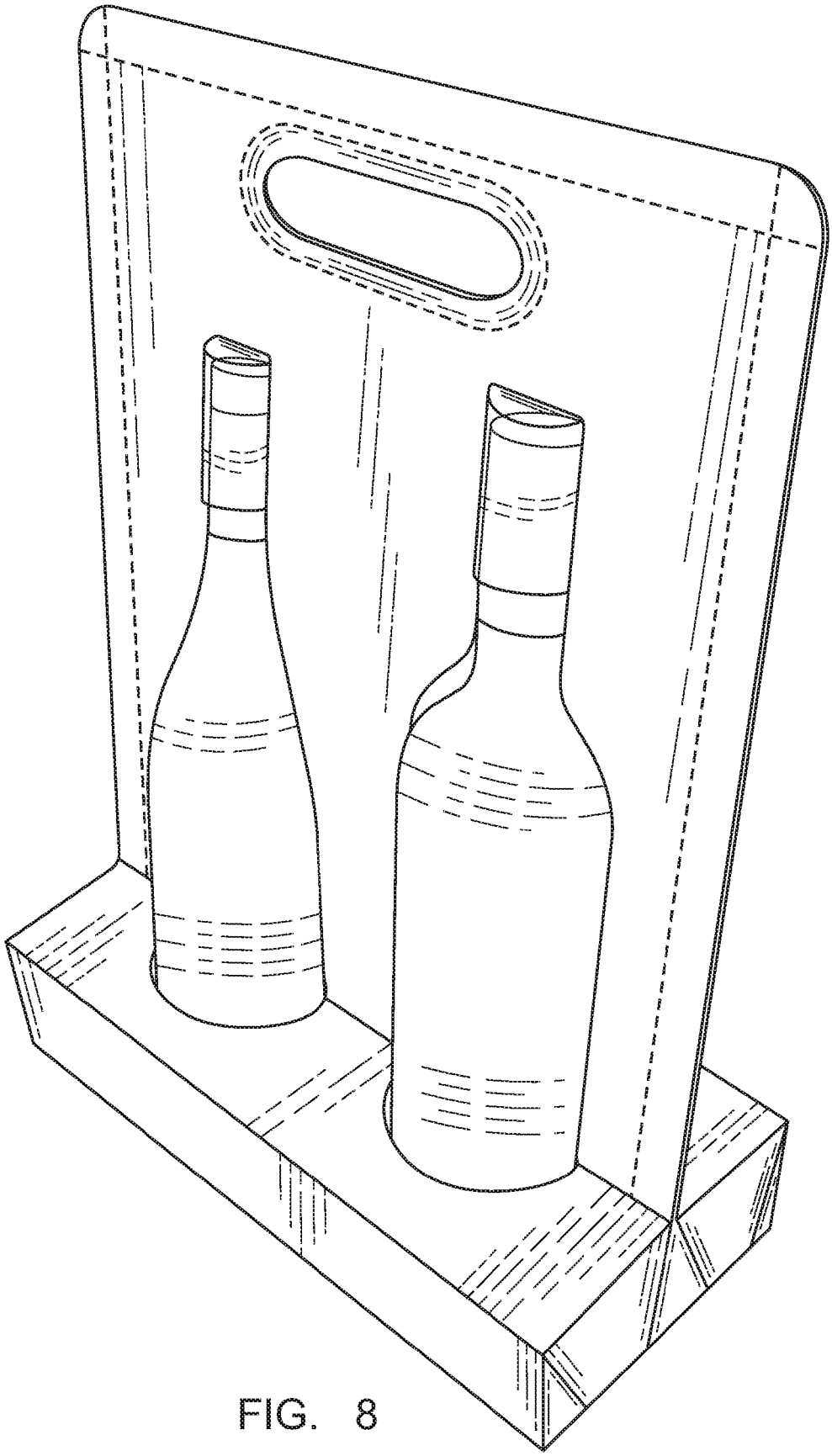
FIG. 8 is a perspective view of a wine carrier packaging two wine bottles according to another embodiment of the present invention.

When sealing the cardboard sections D and E together to form the handle 12, a sealing technique using heat and pressure described in commonly owned U.S. Pat. Appl. Pub. No. 2007/0062836 may be used. Using such technique, the peripheral portion of the handle, and preferably the peripheral portion around the cutout 12*b* as well, are crushed to reduce the air gaps in the corrugations. The crushed peripheral portions are not illustrated in FIG. 1, but are illustrated in FIG. 8 by dashed lines.

The half-formed carrier 10 can be in a fully erect shape as shown in FIG. 3, or a fully collapsed shape as shown in FIG. 4, or a shape in between. It should be appreciated that from the erect state of FIG. 3, the side wall sections G and B can also be pushed in a counterclockwise direction to collapse the carrier 10. Similarly, the handle 12 (sections D and E) can be pushed in either direction (clockwise or counterclockwise) from the state shown in FIG. 3 to collapse the carrier. The carrier 10 in a collapsed state is substantially planner without bulk empty volume enclosed therein.

Figure 5:
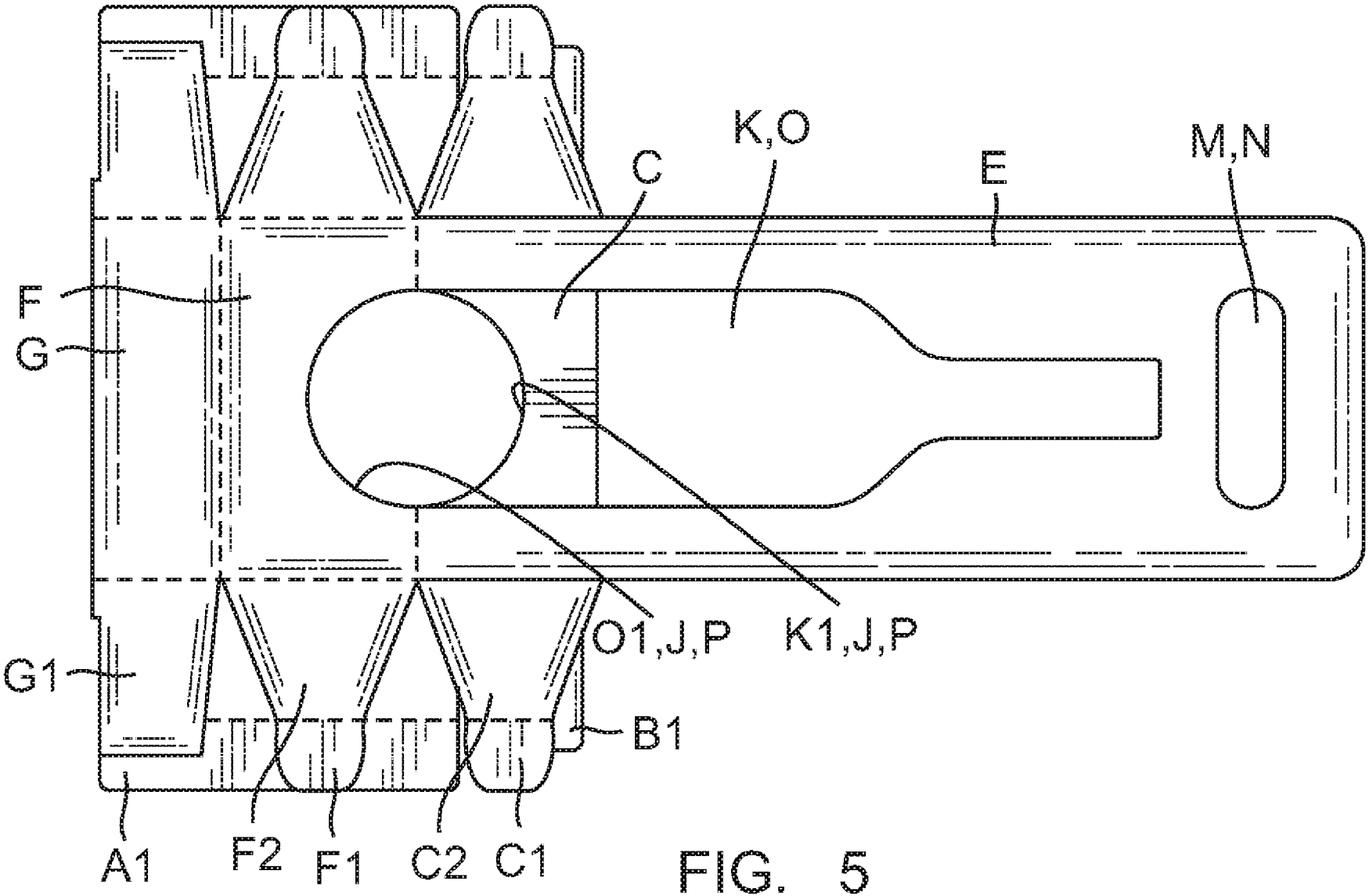
FIG. 5 is a top plan view of the half-formed wine carrier in the collapsed state without a wine bottle.

FIG. 5 shows a top plan view of the collapsed half-formed carrier 10 corresponding to the state shown in FIG. 4. As seen in FIG. 5, the cutout portions O1 and K1 (refer to FIG. 2) jointly form the circular top cutout 11*a* of the box 11. In addition, in this collapsed state, the circular cutout J in sections A and B (refer to FIG. 2) is aligned with the cutout 11*a* formed by cutouts O1 and K1. Further, section H has a cut shape P which aligns with the part of the cutout J that lies in section A. As a result, a through hole is formed in the half-formed carrier 10 in the collapsed state.

Multiple such half-formed carriers 10 in the collapsed state are packed together and transported to a different location to perform the second stage of the packaging process. To package a wine bottle using the half-formed carrier in the collapsed state shown in FIGS. 4 and 5, the wine bottle is inserted into the through hole (labeled "O1,J,P" and K1,J,P") shown in FIG. 5. Then, the handle 12 (sections D and E) is pushed to the upright position, so that the retaining cap 13 (not shown in FIGS. 4 and 5) is located directly above the bottle. The bottle is inserted into the through hole fully (e.g. by pushing the carrier down) so that the neck of the bottle is located inside the retaining cap 13. At this time, the bottom panel (sections H and A) and the side walls (sections G and B) of the carrier can be pushed downward and then sideways (to the right in the view of FIG. 4), so that the bottom panel (sections H and A) slide beneath the bottom of the bottle, and the side walls (sections G and B) are upright.

Figure 6:
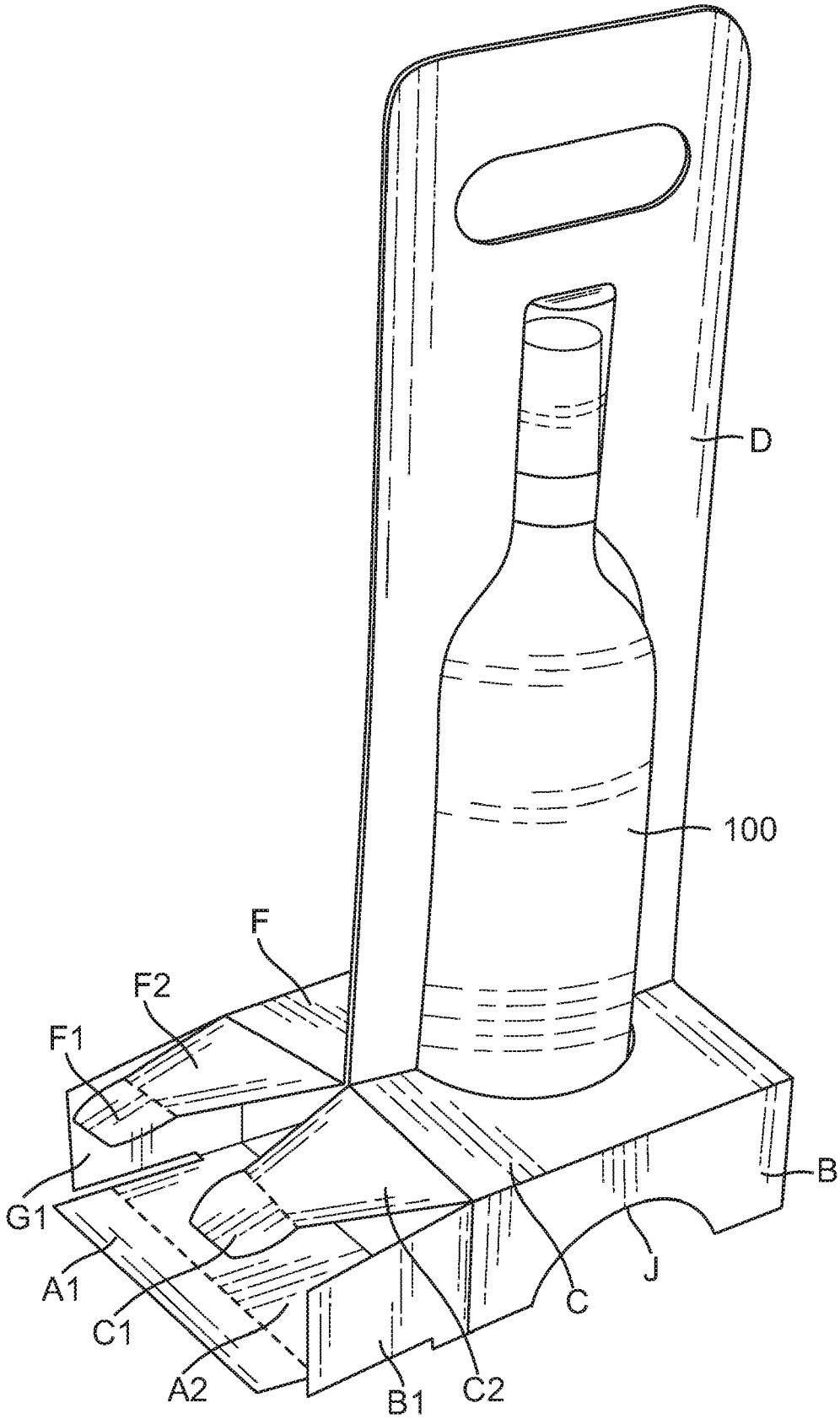
FIG. 6 is a perspective view of the wine carrier with a wine bottle in a nearly completed state with some folding tabs unfolded.

Next, the folding tabs (subsections A1, A2, B1, C1, C2, F1, F2, G1, etc.) are folded to form the box 11. FIG. 6 shows the carrier 10 and the bottle 100, where the folding tabs (A1, A2, B1, C1, C2, F1, F2, G1) are unfolded. The corresponding folding tabs at the far end in FIG. 6 have been folded. Side tabs G1 and B1 are first folded inwardly toward each other. Tabs A2/A1 are folded upwardly so that tab A2 is disposed vertically outside of tabs G1 and B1, and tab A1 is folded horizontally and inserted into a slit formed above the top edges of tabs G1 and B1 and below sections F and C. Lastly, tabs F2/F1 and C2/C1 are folded downwardly so that tabs F2 and C2 are disposed vertically outside of tab A2, and tabs F1 and C1 are folded horizontally and inserted into the pair of slits I (see FIG. 2) located at the base of tab A2. The box 11, after all tabs are folded, is shown in FIG. 1. This completes the second stage or packaging. The wine carrier 10 with the bottle 100 packaged therein is free standing, strong and stable.

As shown in FIGS. 2, 3 and 4, the section H and section A of the cardboard sheet have approximately the same length so the bottom panel of the box 11 includes double layers of cardboard sheets. This provides more cushioning for the bottom of the wine bottle. Alternatively, section H can be shorter than section A so long as it can be adequately sealed with section A, resulting in a mostly single layered bottom panel for the box 11.

Although the shapes of various sections of the cardboard sheet 20 are specifically shown in FIG. 2, the shapes of various sections can vary. For example, the height of the box 11 (determined by the size of sections B and G) can vary from that shown in FIG. 2. The lateral size of the box 11 (determined by the sizes of sections A, C, F and H) can also vary. In another example, the size and shape of the folding tabs A1, A2, B1, C1, C2, F1, F2, G1, etc. can vary from those shown in FIG. 2, so long as they can adequately close the box 11 and form a strong and stable box.

Further, although in the illustrated embodiment the bottom sections A and H are adhered together by an adhesive, the package can also be designed so that the box 11 is formed only by folding without adhering any sections together.

Still further, although the box 11 in the illustrated embodiment is rectangular in shape with vertical side walls, the box can also have the shape of a truncated pyramid, or an upside-down truncated pyramid, or other shapes, as long as it provides a stable shape.

The packaging design shown and described above can be used to make carriers for two or more wine bottles. FIG. 8 shows a carrier for two bottles.

In addition, other relatively small items, such as a cork screw, may be packaged in the same carrier for the wine bottle(s). Such small items can be packaged using a conventional blister pack structure, where a cutout is provided on the cardboard sheet(s) forming the handle (e.g., in FIG. 8, in the space between the necks of the two bottles) and a blister chamber protrudes from the cardboard sheets to house the small item.

Although the description above uses wine bottles as an example, the package and the packaging method described above can be used to package bottles of other alcoholic or non-alcoholic beverages or to package any similarly shaped products.

It will be apparent to those skilled in the art that various modification and variations can be made in the wine carrier of the present invention without departing from the spirit or scope of the invention. Thus, it is intended that the present invention cover modifications and variations that come within the scope of the appended claims and their equivalents.

What is claimed is:

1. A sheet of corrugated cardboard or paper board cut into a pre-defined shape for folding into a package for bottles, the package including a box shaped lower portion and a flat handle portion joined to and extending vertically from the top side of the box shaped lower portion, the sheet having a plurality of pre-formed fold lines dividing the sheet into a plurality of sections and subsections, including:

a first section, including a first subsection for forming a bottom panel of the box shaped lower portion of the package, two second subsections joined to two opposite sides of the first subsection for forming first and second side walls of the box shaped lower portion, and two third subsections each joined to a respective second subsection for forming a folding tab;

a second section joined to the first section, including a first subsection for forming third side wall of the box shaped lower portion, and two second subsections joined to two opposite sides of the first subsection;

wherein the first subsection of the first section and the first subsection of the second section define a first cutout having a circular shape;

a third section joined to the second section, including a first subsection for forming a part of a top panel of the box shaped lower portion, and two second subsections joined to two opposite sides of the first subsection for forming folding tabs;

a fourth section joined to the third section for forming the handle portion of the package;

wherein the first subsection of the third section and the fourth section define a second cutout, the second cutout having a half-circular portion located within the first subsection of the third section and an elongated portion located within the fourth section;

wherein the fourth section further defining a third cutout;

a fifth section joined to the fourth section for forming the handle portion of the package, wherein the fifth section defining a fourth cutout;

a sixth section joined to the fifth section, including a first subsection for forming a part of a top panel of the box shaped lower portion, and two second subsections joined to two opposite sides of the first subsection for forming folding tabs;

a seventh section joined to the sixth section, including a first subsection for forming fourth side wall of the box shaped lower portion, and two second subsections joined to two opposite sides of the first subsection; and an eighth section joined to the seventh section for forming the bottle panel of the box shaped lower portion.

2. The package of claim 1, wherein the handle portion includes two overlapping sheets of corrugated cardboard or paper board adhered to each other.

3. The package of claim 2, wherein the box shaped lower portion and the handle portion are formed by folding a single sheet of corrugated cardboard or paper board.

4. The package of claim 3, wherein the single sheet is cut into a shape which defines a plurality of cutouts corresponding to the first cutout of the box shaped lower portion and the second cutout of the handle portion, wherein the sheet has a plurality of pre-formed fold lines dividing the sheet into a plurality of section forming a bottom, two side walls, and the top side of the box shaped lower portion as well as the handle portion, wherein some of the sections have one or more folding tabs for forming the box shaped lower portion.

5. The package of claim 2, further comprising a retaining cap, the retaining cap comprising a hollow cylindrical body open at its bottom and a flat flange extending outwardly from the cylindrical body, the flange being located in a plane passing through an axis of the cylindrical body, wherein the retaining cap is located near a top of the second cutout, the flange is disposed between the two overlapping sheets forming the handle portion, and wherein the cylindrical body protrudes from both sides of a plane defined by the flat handle portion.

6. The package of claim 5, wherein the retaining cap is made of a clear plastic material.

7. The package of claim 5, wherein the retaining cap further includes a protrusion formed in the flange above a top of the cylindrical body, wherein one of the sheets forming the handle portion further defines a third cutout from which the protrusion of the retaining cap protrudes.

* * * * *